US006497563B1

(12) United States Patent
Steffens

(10) Patent No.: US 6,497,563 B1
(45) Date of Patent: Dec. 24, 2002

(54) DRY-COMPRESSING SCREW PUMP HAVING COOLING MEDIUM THROUGH HOLLOW ROTOR SPINDLES

(75) Inventor: Ralf Steffens, Holzgagge 42, D-50389 Wesseling-Urfeld (DE)

(73) Assignee: Ralf Steffens (DE)

( * ) Notice: Subject to any disclaimer, the term of this patent is extended or adjusted under 35 U.S.C. 154(b) by 0 days.

(21) Appl. No.: 09/712,435

(22) Filed: Nov. 14, 2000

Related U.S. Application Data

(63) Continuation of application No. PCT/DE99/01879, filed on Jun. 29, 1999.

(30) Foreign Application Priority Data

Aug. 29, 1998 (DE) ..... 198 39 501

(51) Int. Cl.[7] ..... F04C 18/16; F04C 29/04
(52) U.S. Cl. ..... 418/88; 418/91; 418/201.1
(58) Field of Search ..... 418/88, 91, 201.1

(56) References Cited

U.S. PATENT DOCUMENTS 2,111,568 A * 3/1938 Lysholm et al. ..... 418/201.1
4,375,156 A * 3/1983 Shaw ..... 418/201.1
5,662,463 A * 9/1997 Mirzoev et al. ..... 418/91
6,045,343 A * 4/2000 Liou ..... 418/91

FOREIGN PATENT DOCUMENTS

| | | | | |
|---|---|---|---|---|
| DE | 2461411 | * | 7/1976 | 418/88 |
| JP | 4-159480 | * | 6/1992 | 418/88 |
| RU | 464713 | * | 7/1975 | 418/91 |
| RU | 641161 | * | 1/1979 | 418/201.1 |
| RU | 840481 | * | 6/1981 | 418/88 |
| RU | 953268 | * | 8/1982 | 418/201.1 |
| RU | 987183 | * | 1/1983 | 418/201.1 |

* cited by examiner

*Primary Examiner*—John J. Vrablik
(74) *Attorney, Agent, or Firm*—Akerman Senterfitt

(57) ABSTRACT

A dry-compressing screw pump in the form of a two-shaft positive displacement pump. A first and a second rotor spindle are disposed parallel to each other. The rotor spindles are hollow. A cooling medium is fed at a first front face of the rotor spindles and evacuated at a second front face of the rotor spindles. A cooling medium feeding and evacuation means is connected to an external cooling medium circuit. The inner diameter of the rotor spindles monotonously increases from the first front face toward the second front face so that the cooling medium is conveyed from the first front face to the second front face substantially under the influence of centrifugal force acting on the cooling medium due to the rotation of the rotor spindle.

23 Claims, 4 Drawing Sheets

DRY-COMPRESSING SCREW PUMP HAVING COOLING MEDIUM THROUGH HOLLOW ROTOR SPINDLES

Figure 1:
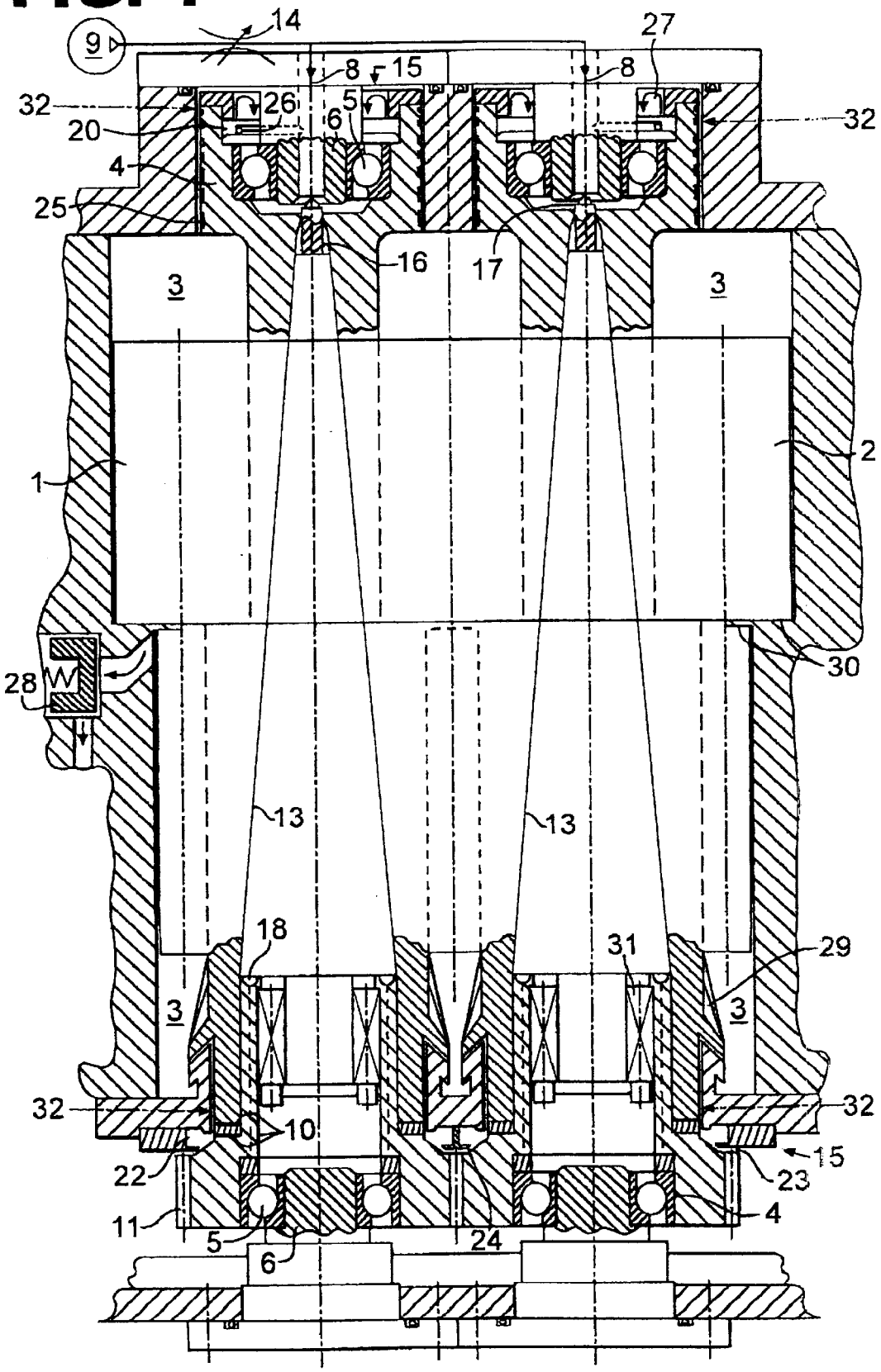

This application is a continuation of PCT/DE99/01829 filed Jun. 29, 1999.

State of the art

Ever greater demands made upon the purity of the pumping medium, increasing operating and disposal expenses as well as ever growing obligations set up by environmental control provisions in an increasing extent require vacuum systems to do without operating fluids that get in contact with the pumping medium. These machines, which are running without any sealing or lubricating medium like water or oil in the compression chamber, are generally called dry or dry-compressing vacuum pumps. No concessions to reliability and operational safety can be made to these pumps of course. The manufacturers of vacuum systems met these requirements with different solutions, the successful principles of all of them lying in the mode of operation of the two-shaft positive displacement pumps. To produce a vacuum, these dry-compressing machines run at higher speed because of the compression ratio required, the compression rotors turning without contact in opposite directions in the compression chamber in such a way that they are placed nearest possible relative to each other and to the encompassing pump casing in order to achieve the desired service life. Among the different principles of the dry-compressing vacuum pumps, the system of the screw pump has proved to be particularly advantageous: two cylindrical rotors arranged in parallel and provided on the surface of the cylinder with helical screw-shaped grooves (deepenings) mesh and form in each indentation a compression chamber that is moved from the suction to the pressure side while the two rotors are revolving in opposite directions. On the screw vacuum pump, the high compression ratio wanted for the vacuum pump can be advantageously and simply achieved directly by the number of closed pumping chambers.

The state of the art to which dry-compressing pumps are pertaining is still characterized by some serious drawbacks: today's dry vacuum pumps do not by far equal the current quality values realized by the known sliding vane rotary vacuum pumps and liquid ring pumps. This is particularly true for the uncontested high reliability and solidity of these vacuum pumps, their compactness, and most of all, the low manufacturing costs. The cause of these difficulties lies in the mostly considerable effort today's dry-compressing vacuum pumps still need to furnish to realize the required features of performance like ultimate pressure and pumping capacity.

The object of the present invention is to conceive a dry-compressing vacuum pump that is as simple and robust as possible as well as particularly inexpensive and compact in order to achieve, thanks to the dry mode of operation, considerable improvements in producing vacuum compared to today's state of the art.

According to the invention, the solution of this object is to have the two positive displacement spindles designed in such a way that they are hollow throughout inside and to lead a permanent coolant flow, preferably oil, directly through each of the two compressing cylinders in order to evacuate the heat proceeding from vacuum generation from each of the spindle rotor in a continuous and reliable way.

In this heat transport in the rotor, the better heat transmission coefficient between the material of the positive displacement rotor and the cooling medium with a simultaneously smaller inner surface of the rotor's cylinder compared to a greater heat absorbing outer surface of the positive displacement rotor with a smaller heat transmission coefficient between the rotor material and the pumping medium is advantageously utilized in favour of a well balanced thermal current in the rotor so that, according to a simple thermodynamic layout, the amount of heat that is picked up and the one that is carried off are balanced as desired. The level of temperature may advantageously be adjusted and controlled on purpose for each case anew by controlling the amount of coolant. It is hereby very important to see to it that the amount of coolant is evenly distributed between the two positive displacement rotors by way of appropriate monitoring systems. To improve the cooling effect, the inner bore of the rotor should additionally be advantageously provided with an inner feed screw thread oriented in the direction of rotation in order to improve the inner surface of heat exchange between displacer and coolant as well as the flow of the coolant by way of an appropriate orientation of the thread. The direction of rotation of each positive displacement rotor is unmistakably established according to the lifting direction of the pump so that the orientation of the inner thread of the positive displacement rotor's bore may be designed in precisely such a way that, according to this established direction of rotation of the rotor, the flow of its cooling medium is aided and reinforced.

Another suggestion is to advantageously design the above mentioned inner bores of the rotor with additional option on a thread in such a conical way that the smaller bore diameter is located at the inlet side of the cooling medium and that the somewhat larger bore diameter comes to lie on the outlet side of the cooling medium, so that the conveying effect of the cooling medium is reinforced with the help of the centrifugal force, thus improving even more the cooling of the rotor. It is hence advantageously also possible to operate this vacuum screw pump with the pair of positive displacement rotors either standing upright or orientated in horizontal direction.

For a most effective rotor cooling, the invention additionally suggests designing the surfaces of the rotor's inner bore in the way required by the dissipation of the loss heat of compression. For the output of the compressor and accordingly the occurring power loss as well are not constant in the longitudinal direction of the positive displacement rotor, so that the corresponding surface values are advantageously worked out to be greater in the areas of higher heat loss of the compressor. In general, this particularly concerns the area of the positive displacement rotor located nearer to the outlet and the areas in which the volumes of the work chambers are submitted to greater changes. There is also the possibility to maximize the size of the rotor's inner surface by having the outer curve with the cylindrical grooves followed by the inner hollow curve of this contour by minimizing the overall thickness of wall of the rotor. Besides the mechanical transformation, the technical realization may also be accomplished by explosive forming of an appropriate thin-walled tube or by sheet packing according to EP 0 477 601 A1.

The overall flow of cooling medium is preferably realized in a defined way by means of a pressure generating pump of its own so that this cooling agent (preferably oil) may not only be led in a controlled way through the cavities of the displacer, through storage of special sealing elements as well as through synchromesh and driving gear, but that it may also simultaneously be guided in a controlled way past the housing, if possible with the help of gravity, in order to carry off the heat absorbed. This process, which is permanently repeated in a closed circuit is aided in its task by the well-known additional external possibilities for exchange of heat, starting with a ribbed housing, which is the appropriate material for a casing, and with a simple ventilator and ending with the additional heat exchanger connection through which the flow of coolant directly passes. Alternatively and instead of the pressure generating pump of its own, the kinetic energy of the rotor's rotation may be utilized particularly for smaller-sized machines by connecting an oil pump of its own to the positive displacement rotor according to the well-known principles.

In this way, the temperature distribution in the whole machine may advantageously be much more uniform for dry-compressing vacuum pumps and thus meet the standards usually only met by the well-known sliding vane rotary machines and the liquid ring pumps. These temperatures, which have to be as homogeneous as possible, are an essential condition for the robustness and the reliability of a vacuum pump and are always looked upon as one of the most important development targets that could not yet be achieved on today's dry-compressing vacuum pumps because of the in part extreme differences in temperature which involve considerable operational hazards.

In order to carry out this lucrative cooling of the rotor in a particularly advantageous manner, the invention suggests carrying each positive displacement rotor 1, 2 directly on the front face on at least the one rotor side by which the coolant is discharged in enclosure-like rotor elements 4 through which on one side the desired quantity of cooling agent is directly fed into each of the through bores of the positive displacement rotor and discharged again at the other end. To this effect and as shown by way of example in the illustration according to FIG. 1, the bearing 5 of the rotor is accomplished in such a way that the inner ring of the bearing is resting upright on a projection 6 being unremovably fixed to the housing while the outer ring of the bearing located in the enclosure-like rotor element 4 permanently rotates with the positive displacement rotor 1 or 2. By thus carrying the rotor in bearings, a maximum dynamic stability is achieved on both sides right on the front face of the displacer, the critical whirling speed being far beyond the operating speeds, since on one side the spacing between the bearings has been minimized and because on the other side the stiffness values between the bearings have been optimally increased.

Figure 3:
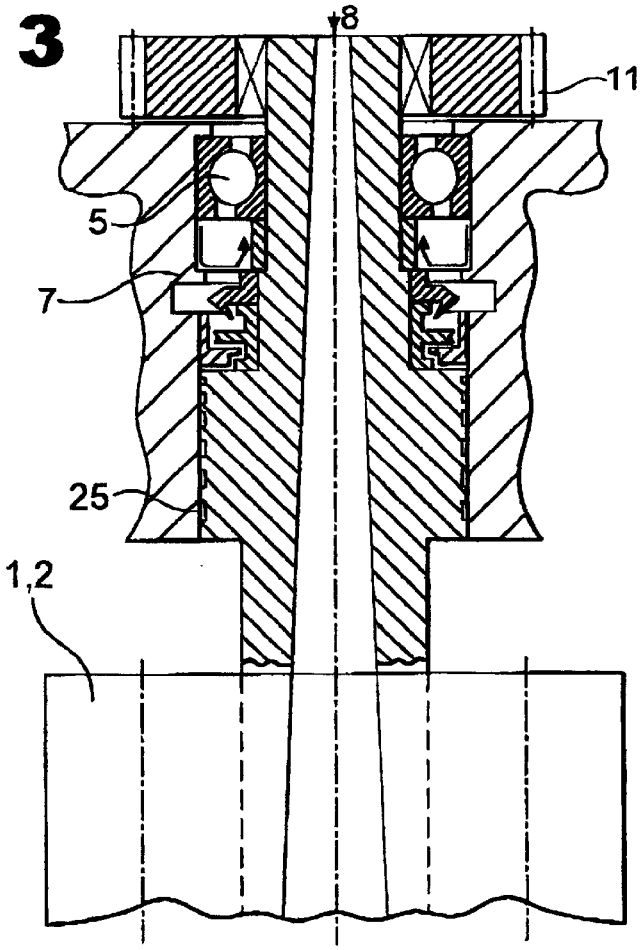

At least on one side this way of carrying the rotor in bearings may however be relinquished by having, according to the enclosed illustration in FIG. 3, the inner ring of the rotor's bearing 5 located on the positive displacement rotor and the outer ring of the bearing resting on the side part 7, which is unremovably fixed on the casing.

To reduce the number of shaft entries into the compression chamber, for example for particularly complicated cases in which a pump has to be used, and while avoiding carrying the rotor on the suction side, the well-known one-sided, so-called cantilever bearing of the rotor may be advantageous. According to the enclosed illustration in FIG. 2, the advantageous cooling of the rotor may also be realized for these cases of application by having the projection 6, which is unremovably fixed to the casing, protruding far into the bore of the positive displacement rotor, carrying the two inner rings of the bearing as well as taking charge of the coolant supply 8. The radial strain on a screw vacuum pump being small, the flexural strength required for this projection supported only on one side can be easily realized by providing the lower bearing 5*a* with a larger inner diameter, which at the same time permits to absorb the higher axial forces generated by the difference in working pressure of the pumping medium. In smaller screw pumps, the upper bearing 5*b* may also be designed as a radial package type needle bearing for example or as a lubricated sliding bearing.

A small part of this flow of coolant, preferably oil, is directly employed to lubricate and cool down the bearings carrying the rotor so that a maximum of safety, reliability and durability is achieved for these bearings. This branching in the coolant supply 8 is for example performed via a shoulder 17 provided in the conical insertion part of the rotor 16 or via bores 10 in the rotor elements as well as by means of oil overflow from the collecting pipes 18, by means of spraying oil when taking it out of the oil way by way of pressure tube 19, wherein the required quantity of lubricant may be advantageously adjusted by dimensioning these elements accordingly.

Another part of the flow of cooling medium is advantageously utilized at the same time to lubricate and cool the synchromesh gear. The supply hereby occurs via the distribution bores for the lubricant 10 or via the controlled conduct overflow 24 of the siphon shaft seal 22—see explanation herein below.

Besides this difficulty in cooling, today's screw vacuum pumps are mainly designed with a cantilever rotor so as to avoid carrying the rotor on the suction side. This important advantage should be obtained under any circumstances without however also adopting the drawbacks regarding the cooling of the rotor and the critical whirling speed. It is also very desirable at the same time to elude the axial forces generated by this cantilever way of supporting the positive displacement rotor because of the difference in pressure of the pumping medium, since they constitute the substantial strain on the bearing with regard to reliability and durability.

In the present invention, the solution of this object is to use the double-entry type which is well-known with screw pumps so that the gas no longer enters the rotor by the front but inside the longitudinal side of the rotor and that the pressure prevailing at the side of the outlet adjusts on either front face of the rotor to nearly equal the atmospheric pressure. The invention hereby suggests designing both sides of the displacer pair with the same feed screw thread on larger screw vacuum pumps (that is such having more than approximately 100 cubic meters per hour of nominal suction capacity), so that the flow of gas to be lifted may be distributed evenly. The required centre distance and hence the size of the pump may thus be advantageously be reduced, whereas the overall length is increased, the manufacturing costs of such a machine being reduced accordingly altogether.

For smaller screw vacuum pumps (having a nominal suction capacity of less than approximately 100 cubic meters per hour), one part of the displacer pair (the upper part when the conveying direction is vertical) may just be designed as a simple leakage feed screw thread, in order to only return the inner gas back flow on account of the difference in pressure between the inlet and the outlet side of the pump. This leakage feed screw thread may hereby be designed as a simple feed screw thread in the full cylinder which is unremovably fixed to the housing either by reciprocal engagement of the rotor with the other displacer spindle or separately, said thread being comparable to the so-called Golubev thread.

This solution of the invention advantageously adopts the advantages of today's dry-compressing screw vacuum pumps by renouncing to have the rotor carried on bearings on the suction side and simultaneously overcomes the deficiencies regarding the considerable axial forces for bearing the rotor.

The required sealing between the necessarily dry, that is oil free compression/work chamber and the oil-lubricated side/bearing areas is first of all achieved by way of long sealing paths and is hereby aided by simple labyrinth seals preferably working without contact via Golubev leakage feed screws and different well-known shaft seals. Both front faces of the pump may hereby be firmly connected to each other by way of a simple gas conduit, providing thus constant pressure compensation so that the difference in pressure at the shaft entries into the compression chamber is minimized.

Particularly advantageous seals utilized in the present invention for the shaft entries into the compression chamber are special centrifugal shaft seals as they are illustrated in FIG. 1. On the side on which the coolant is supplied, a slim sealing disk 21, rigidly mounted on the projection, engages into a rotating siphon 20 that gets its fluid from the lubrication of the bearing on one side and that, on the other side, always fulfills the necessary discharge of fluid and heat via a pressure tube 26 rigidly mounted on said sealing disk. This sealing system with the rotating siphon may also directly be used on the discharge side of the coolant/lubricant, as it is shown by way of example in the illustration according to FIG. 5.

In order to perform the cooling of the displacer screw as it has been described in this invention, the coolant, preferably oil, has to be brought permanently and safely into the rotating inner surface of the rotor's cylinder and must be discharged again in the end.

This oil supply toward the rotor shaft, which occurs on the projection being unremovably fixed to the casing, is accomplished by way of a special conical insert 16 provided in the rotor's bore having a matching counterpart (designed for example as the land of the bore) on the projection integral with the casing, in order to ensure that the oil is distributed as evenly as possible. This rotating insert 16 is hereby given a shoulder 17 in the tapered surface of its cone which is such that the coolant/lubricant fed via the projection at 8 impinges onto the cone insert 16 and is sprayed back toward the desired small part, thus coming to lubricate the arrangement of bearings for the rotor 5 and to supply the siphon 20. The considerably larger flow of oil is led through groove-shaped recesses provided in the insert 16 into the bore of the displacer for the purpose of carrying off the loss heat of compression.

Since this rotating siphon only can act as a dynamic seal, a contacting shaft seal 27, for example the well-known rotary shaft seal, is additionally inserted as static seal into the rotating rotor element in such a way that said rotating rotor element safely seals at standstill and that, when rotation begins, that is when the siphon seal undertakes to seal, its sealing lip starts to rise on account of the effect of the centrifugal force, optimal wearing protection being thus advantageously provided at the same time.

In order to minimize the difference in pressure on this compression chamber shaft seal system, the afore described Golubev leakage feed screw thread 25 is utilized for example on the outer diameter of the enclosure-like elements. As already described, other possibilities for returning the inner leakage may alternatively be realized. Further seal elements of well-known design and acting mainly in axial direction may be additionally arranged on the front side of the enclosure-like elements. In more complicated cases of application, the usual utilization of seal gas as an inert gas along the advantageously long sealing paths is possible any time in an advantageous way with best appropriated conductance. In the enclosed illustrations, the seal gas option is indicated as an example by means of a double dot-dash line 32.

The necessary leakage of oil always occurs at the front face of the rotor provided with the enclosure-like rotor elements and when as preferred the pumping direction is vertical, advantageously at the bottom, whereas, according to the illustration shown in FIG. 3, the oil supply may also be done on that front face of the rotor where the inner ring of the rotor's bearing lies directly on the prolonged end of the shaft of the positive displacement rotor. According to the illustration in FIG. 2, the cooling and lubricating means may now be carried away out of the inner cylinder of the rotor with the help of centrifugal force via a collecting pipe 18 provided with discharge bores and with a branch hole leading to the synchromesh gear and/or via a pressure tube 19 engaging directly from the projection integral with the casing into the collecting pipe 18 located on the side of the rotor.

In the illustration shown in FIG. 1, the leakage of oil is not only used to advantage to lubricate the bearings but serves at the same time to feed the sealing siphon and to lubricate the synchromesh gear. As opposed to the upper siphon, in this siphon it is the slim sealing disk that rotates, the adjacent side walls of the siphon being integral with the casing. The necessary lubrication of the synchromesh gear is thus performed in a particularly advantageous manner thanks to the controlled channel overflow of the siphon compression chamber shaft seal in the meshing zone of the gear of the synchromesh transition, the siphon side wall being taken back in precisely this region. This kind of lower compression chamber shaft seal combined with the simultaneous supply of the synchromesh gear according to the illustration shown in FIG. 1 is of course also appropriate and may be used in the same way for the cantilever bearing according to FIG. 2.

Such a screw vacuum pump is preferably designed with a pair of positive displacement rotors standing upright, the pump casing encompassing the positive displacement rotors being in any case designed in such a way though that the discharge of liquid out of the pumping chamber which might become necessary is ensured any time with the help of the centre of gravity, the outlet port of the pumping medium always being located at the geodetic deepest position.

The synchronization of the two positive displacement screws is performed by a simple, well-known oil-lubricated spur gear. The drive with the simultaneously necessary increase in speed preferably occurs via a larger spur wheel that actuates this synchronizing step directly or by way of a simple transmission step. In this case, the driving motor is preferably arranged so as to be parallel to the screw pump. The driving motor may also, not only for smaller machines, be arranged in direct prolongation of a displacer spindle, the increase in speed being achieved by means of a frequency converter.

Another important attempt at improving dry-compressing screw vacuum pumps of the art according to the invention is to minimize the required driving power in order to considerably relieve the thermic situation of the complete machine. Indeed, the smaller the power fed, the easier it is to keep the temperatures inside the screw vacuum pump within reasonable limits with appropriate cooling expenditure and, in the stage of development following next, to reduce the size of the pump and hence the manufacturing costs of the machine as a whole.

This minimization of power input is achieved by a special kind of inner gradation. It reduces on purpose the volume of a work/pumping chamber from the beginning of the suction procedure to the outlet. For the process of compression, the best would be a variable constant inner gradation which continuously adapts to the various pressure conditions. On dry-compressing screw vacuum pumps this could be for example realized by using valves, but experience showed that these valves are not appropriate for dry pumps with regard to their durability and reliability.

Figure 2:
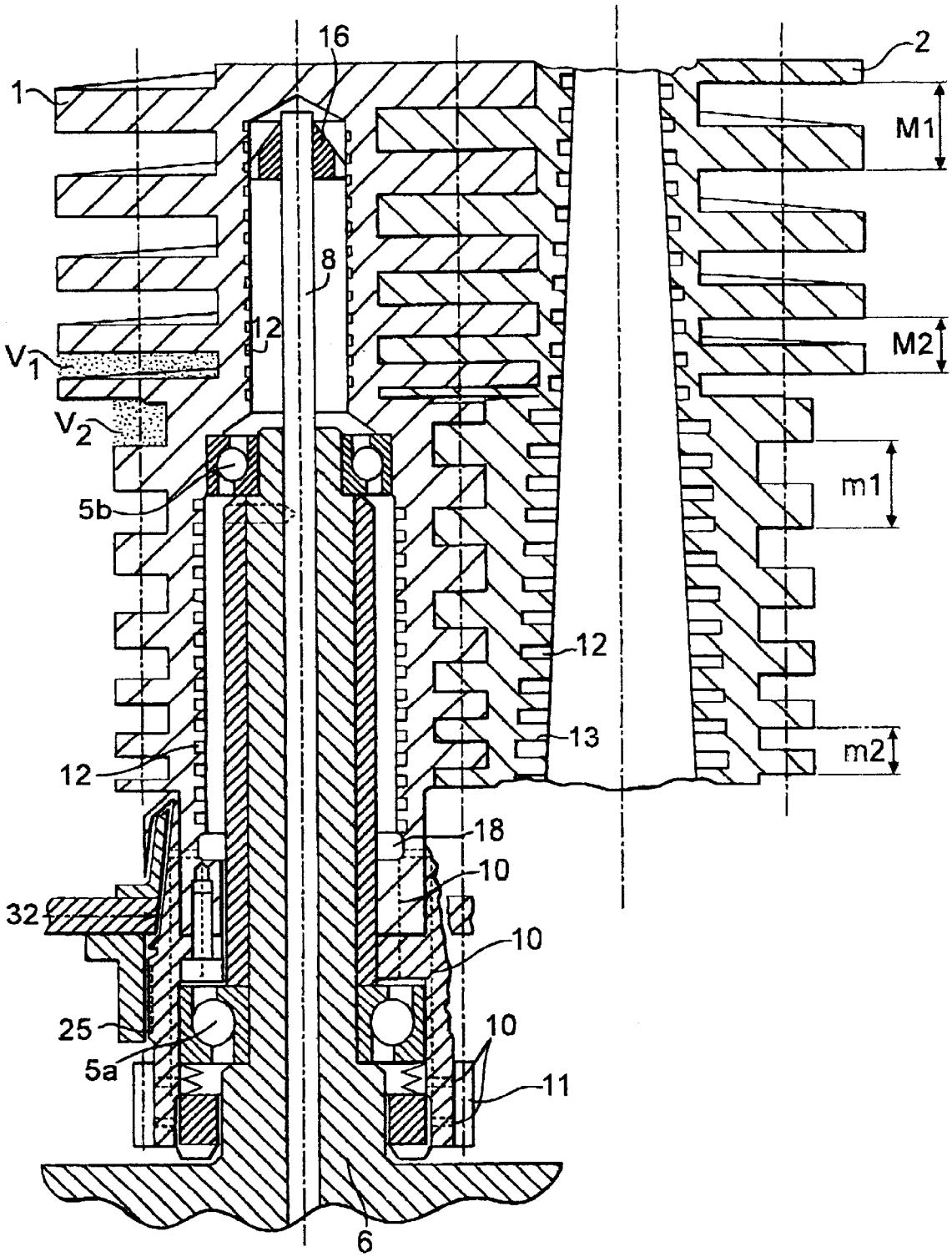

According to the invention, this gradation is achieved by the varied combination of two factors of the inner gradation as a modification of the volumes of the pumping chamber according to the illustration in FIG. 2. As a factor one value is comprised between 1.5 and 2.2 and preferably amounts to approximately 1.85 and is technically employed by reducing continuously the pitch of the spindle by this very factor, the outer diameter of the positive displacement rotor remaining constant. The second value lies between 2.0 minimum and 9.0 maximum as a factor, preferably between approximately 4.0 and 6.0 and is technically employed by reducing the volume of a work/pumping chamber by precisely this factor by modifying abruptly the geometry parameters of the rotor, the outer diameter of the positive displacement rotor and, on the same level of significance, the height of the tooth indent as well as, with greater values, the pitch of the rotor's spindle to achieve this factor being reduced accordingly in combination.

Each spindle rotor thus consists in 2 feed screw sections, one part being designed with a continuous change in pitch (factor of about 1.85 to reduce the volume of a work/pumping chamber), the outer diameter of the rotor remaining unchanged, whereas in the adjacent second section of the rotor spindle the volume of the work/pumping chamber is abruptly reduced by a factor preferably comprised between 4 and 6 by reducing abruptly the tooth height and possibly the pitch of the spindle. The sequence of these considerations is oriented from the suction side toward the discharge side. It may however also be reversed by having first the large gradation between the preferred factors 4 and 6 and then, after an abrupt reduction of the outer diameter of the rotor in the second pumping section of the spindle, the continuous change in pitch of about 1.85. The meshing counter spindle rotor must of course be realized with a corresponding change in its geometry.

It still has to be noticed that in abruptly changing the geometry of the rotor, the two spindle sections cannot be interconnected in an unlimited sealed way, since the opposite rotor engagement is always submitted to slight variations and since contact between different sections of the displacer must by all means be avoided so that a small gap must be provided between the two different sections of the rotor. This measure directly corresponds to a reduction of the outer diameter of the rotor and advantageously ends just underneath the height of the pitch circle.

As is well known, the suction pressures generated at the intake during the process of pumping out are higher so that excess pressures will obligatorily build up primarily at this place of transition of the rotor's section due to the reduction in volume of the work/pumping chambers, wherein said excess pressures may lead to overload. In order to avoid these excess pressures, there must be simultaneously provided at this place on the side of the casing an excess pressure protection 28 which works in a well-known way as a simple spring and/or as a weight-loaded valve with the objective to carry away excess pressure toward the outlet.

In order to reduce overcompression in case of higher suction pressures at the position of the rotor with the abrupt reduction in volume of the work/pumping chambers, the present invention additionally suggests realizing the displacer section with the hitherto constant volumes of the work/pumping chambers at still constant outer diameter of the rotor with a continuous reduction of the rotor's pitch. This value of the variation in pitch should also be comprised between 1.2 and 2.2, and should preferably amount to about 1.85. In some cases of application of the pump, the possible overcompression in the section of the rotor with continuous variation in pitch at a value of about 1.85 may not be wanted so that this invention additionally also suggests to evenly distribute this preferred value between the two sections of the rotor, that is to design both displacer sections with a continuous variation in pitch of approximately 1.36 to 1.40.

As is well known, the inner gas leakage through the slot inside the work chamber of the pump, which is unavoidable on dry-compressing vacuum pumps, impairs the compression capacity of these machines. To embody the lower gradation, the invention suggests designing the first rotor section on the suction side with a smaller variation in pitch than the second rotor section to fit the purpose of improving the compression behaviour.

Additionally, the variation in pitch should follow a nonlinear curve, for example a quadratic function, so that the variation in pitch (seen from the suction side) rises slowly at the beginning and in a stronger way later, when it reaches the end of the first rotor section, so that the ratio obtained from the quotient of the final pitch to the starting pitch attains the wanted value, which is comprised between 1.2 and 1.8, whereas the preferred value suggested amounts to approximately 1.5. The same attempt at designing a curve of the variation in pitch is made for the second rotor section with the only two differences that on one side the starting pitch of the second rotor section is abruptly smaller by a factor between 2.0 and a maximum of 8.0 than the final pitch of the first rotor section and that on the other side the variation in pitch, which is nonlinear as well, has a ratio of the end pitch to the starting pitch which is relatively higher by a factor 1.2 to 1.8 compared to the ratio of the first rotor section, whereas an absolute value of about 2.0 is suggested for the ratio of the second variation in pitch. As a result, the march of pressure along the cylinder of the positive displacement rotor between the position of intake and that of discharge advantageously is described in such a way, seen from the side of intake, that the increase in pressure is as soft as possible and that the critical delivery pressure between the two rotor sections does not impair too much the compression capacity of this vacuum pump with regard to its size as well as to its position. Therefore, the first rotor section has to be provided with sufficient length, that is with at least a number of steps of 2.0.

The illustration according to FIG. 2 shows an example of an embodiment of the inner gradation in which the pitch continuously changes from a value M1 toward a value M2 in the first feed screw section so that finally, the volume of a work/pumping chamber attains the value V1. In the transition between the two feed screw sections, this volume is reduced to the value V2 by at least abruptly reducing the outer diameter of the rotor. In the second feed screw section, the pitch of the spindle is finally continuously reduced from the value m1 to the value m2.

To further improve the compression behaviour of this dry-compressing screw pump, the present invention additionally suggests designing the curve of the profile flank in the following way:

Usually, the curves of the profile flanks are identical in front section for both spindle positive displacement rotors and correspond from a mathematically equidistant point of view to the well-known course of the cycloid. The drawback thereof however is that on one side the circular engagement line does not extend far enough so as to come sufficiently close to the edge of cut of the two cylinder surfaces inside the casing and that on the other side and according to the law of toothed wheel work the involute gear is very susceptible to the slightest centre distance variations occasioned for example by divergences in manufacturing or by differences in temperature because the cycloid describes a bend in the area of the transition to the pitch circle in the first derivation of the profile pitch, hence being discontinuous in the subsequent derivation. These two characteristics of the cycloid reduce the compression capacity of the entire machine because the inner gas leakage between the two positive displacement rotors is thereby increased. The present invention now suggests mathematically designing the curve of the profile flank in the area of the pitch circle as an involute, that is to design it in the area of the pitch circle with a variation in pitch of the profile of a value of −1. It also suggests bringing the engagement line nearer to the edge of cut of the two cylinder surfaces inside the casing so that the inner gas leakage there is reduced. Still another suggestion to improve the sealing effect between the two flanks of the rotor spindles and hence of the increased compression capacity is to have the curve of the flank composed of several profile outlines meshing simultaneously. According to the law of toothed wheel work, the pitch point positions of the corresponding profile flanks are superimposed, a double superimposition being sufficient in most cases.

It is obvious and therefore only alluded to for the sake of completeness that, instead of a division into two parts, a division into three or more parts is also possible and may even be sensible for some embodiments, particularly for larger machines. In addition, in the embodiment of the rotor spindle, the two-teeth type is to be preferred because of its more advantageous balancing capabilities while at the same time the need for constructional length is reduced for the purpose of attaining the number of steps.

For better understanding it has to be noted that the first rotor section is to be considered primarily as a volume generator (more accurately: a generator of suction speed), while the second rotor section serving as a pressure generator must overcome the larger absolute pressure difference.

The idea of the volume generator (more accurately: the generator of suction speed) may now be advantageously followed to make this dry-compressing screw pump also successfully apt to be used in other cases of application:

Usually, these dry-compressing screw pumps are employed in vacuum technology to compress gas relative to the atmospheric pressure on the side of discharge. According to the invention, this machine may now be utilized directly as a Roots pump by simply exchanging the pair of positive displacement spindles by drastically increasing the profile pitch. At same or at least similar driving power, the achievable difference in pressure between intake and discharge drops, which precisely corresponds to the case of application of the Roots vacuum pump. Hence, the best appropriate vacuum pump for each case of application for a pump with its specific values for suction capacity and difference in pressure may be provided in an easy and advantageous manner by way of a modular construction kit of the dry-compressing screw pump.

In addition to the described advantageous cooling of the rotor, the pre-intake is used for gas cooling. In a known procedure, cool gas is routed into the still closed work/pumping chamber where it mixes with the pumping medium because of the prevailing difference in pressure and brings about a drop of the gas temperature in the work/pumping chamber as well as a reduction of the differences in pressure the moment the work/pumping chamber opens on the side of discharge so that the development of noise due to gas pulsations is reduced.

To reduce the described supercharged compression at higher suction pressures, the direction of this pre-intake flow is simply reversed, thus acting as an automatic overload protection.

In order to reduce noise, the discharge edges should be soft, this being achieved in having the opening behaviour of each work/pumping chamber follow a function depending upon infinitesimal rotation and in avoiding any abrupt change in section when the work/pumping chamber is being opened.

To reduce noise, the invention additionally suggests disturbing effectively and reducing the pressure pulsations and gas column oscillations by way of additional ventilation wheels 29 provided at the end of the shaft which is located on the side of discharge according to the illustration in FIG. 1 herein enclosed.

In the illustrated examples of embodiments.

FIG. rows a longitudinal sectional view through a two-shaft pump of the invention with a rotor carried in bearings on either side, continuous cooling of the spindle rotor and the siphon shaft seal systems provided on either side. The spur gear 11 is non-rotatably linked with these spindle rotors 1, 2 by way of tensioning elements 31 for the purpose of achieving accurate adjustment of synchronization for the two positive displacement spindles.

FIG. 2 hows a longitudinal sectional view through the dry-compressing screw pump with an example of an embodiment of the rotor gradation and by way of example, for one positive displacement spindle, the cantilever bearing of the rotor on the projection 6 integral with the casing together with the coolant/lubricant supply 8.

FIG. 3 shows the possible bearing of the rotor 5 with the outer ring of the bearing integral with the casing and with the inner ring of the bearing located on the rotor shaft together with the synchromesh gear 11 on the intake side of the coolant/lubricant.

Figure 4:
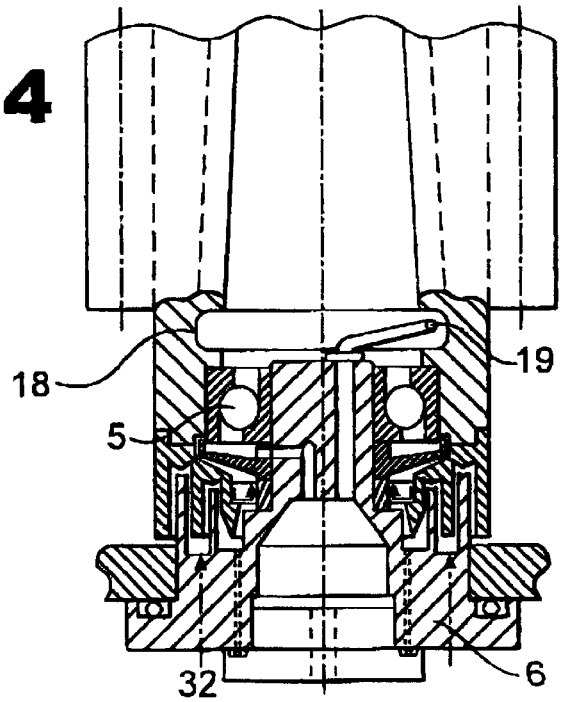

FIG. 4 shows a particularly space-saving embodiment for the side of discharge aiming at minimizing the changes in section for the outlet of gas of the pumping medium on the side of discharge by having the rotor 5 directly carried on the projection 6 integral with the casing without synchromesh gear and be realizing long labyrinthine sealing paths with seal gas option 32. The coolant/lubricant is tapped out of the displacer cavity via the collecting pipe 18 and the stationary pressure tube 19 that is engaging into said collecting pipe and is carried off through a coaxial bore in the projection 6. Splash oil suffices to lubricate the bearings in this tapping procedure.

Figure 5:
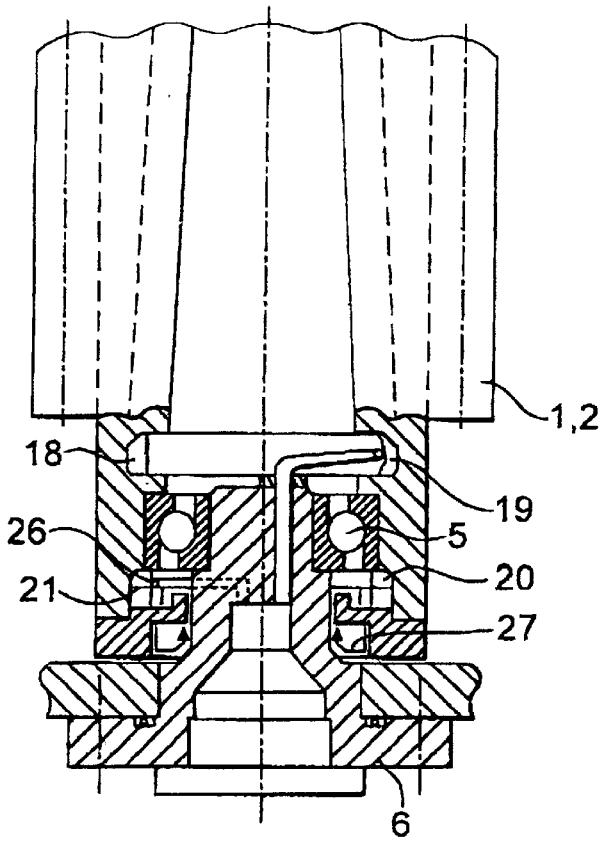

FIG. 5 shows, in a way similar to the illustration in FIG. 4, the bearing 5 carrying the rotor on the side of discharge in the enclosure-like prolongation of the rotor on the projection 6 integral with the casing together with a rotating siphon seal 20 and a stationary sealing disk 21 as well as with a radial packing ring 27. The synchromesh gear must be provided on the other front face of the rotor so that the best possible conditions for designing the location of the outlet for the pumping medium may be achieved.

In a variation of the illustration in FIG. 1.

Figure 6:
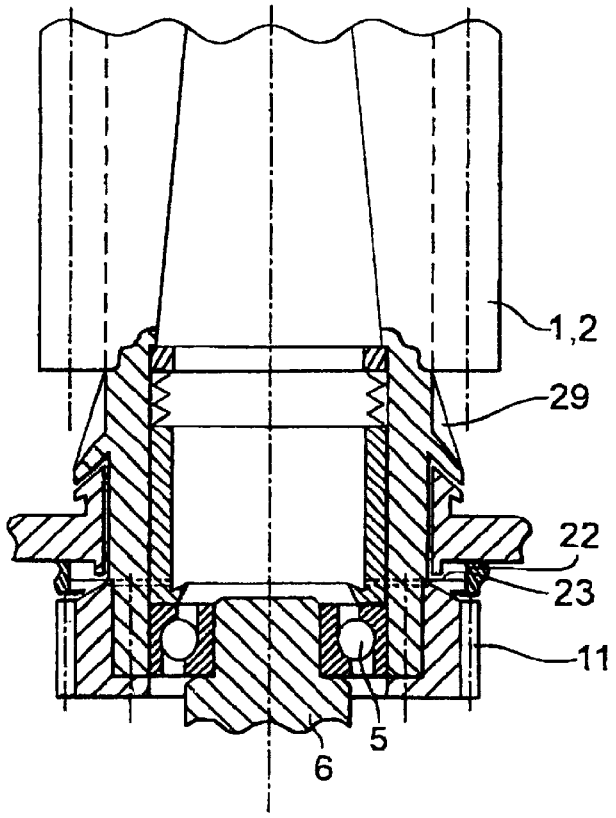

FIG. 6 shows for the front face of the rotor located on the outlet side another way to fasten the synchromesh gear 11 to the rotor spindle 1, 2, the rotor being advantageously carried in a bearing 5 directly in the prolonged displacer spindle.

The embodiments of a dry-compressing screw pump mentioned are particularly advantageous for the vacuum technology, but they may just as well be used for other cases of application with the unique restriction that these pumps may only be utilized to deliver gas since they assume that the pumping medium is compressible.

The dry-compressing screw pump is embodied in the form of a two-shaft positive displacement pump for lifting and compressing gases with a rotor spindle pair 1, 2 disposed parallel to each other in a closed compression chamber 3 with an inlet and an outlet, both rotor spindles being hollow and a coolant/lubricant being constantly fed and evacuated. Essentially enclosure-like rotor elements 4 are at least provided on that front face of the rotor on which the coolant/lubricant is discharged. The sliding or rolling bearings 5 for these rotor front faces are on one side resting on the inner wall of these enclosure-like rotor elements and on the other side on a static projection 6 extending into said enclosure. The coolant/lubricant is advantageously continuously brought into these rotor cavities on the one side of the rotor and are permanently discharged on its other side, whereas the supply 8 of coolant/lubricant may particularly be performed via the projection 6 integral with the casing. Particular advantages arise from distributing and feeding the coolant/lubricant via a conical insert 16 with a throw-off shoulder 17 as well as with groove-shaped recesses in the rotor cavity on the feeding side.

In a preferred development, the inner bores of the rotor are additionally equipped with an inner feed screw 12 as shown in FIG. 2 for rotor 2 oriented toward the direction of rotation in such a way that, according to the determined direction of rotation of each positive displacement rotor, the passage of cooling agent there through is aided.

Further advantages are obtained when the inner bores of the rotor have a conic shape (13) such that the smaller bore diameter lies on the intake side of the cooling medium and the larger bore diameter comes to lie on the discharge side of the cooling medium.

Thermal advantages are obtained when the surfaces of the inner bore of the rotor are designed as required for carrying away the loss heat of compression.

Another advantage is attained by designing the rotor's inner surfaces to follow the outline of the outer contour of the rotor.

On the pump 9, the cooling medium can form a film having a thickness of less than 5 mm on the inner surfaces of the rotor. On the pump 9, the speed of the rotor spindles 1, 2 can be more than 5000 revolutions per minute.

The current of coolant/lubricant is advantageously realized by a pressure generating pump 9. The current of coolant/lubricant may particularly be energetically generated by the positive displacement rotors by means of an own oil pump. By controlling 14 the quantity of coolant, the temperature level may be adjusted and regulated on purpose. Particularly the quantity of coolant per positive displacement rotor may be monitored and adjusted so as to be equal for both positive displacement rotors. For heat exchange, the coolant/lubricant is advantageously led past the pump casing.

Particular advantages are obtained by using part of the coolant/lubricant to supply the rotor bearing 5 of the synchromesh gear 11 or of the shaft seals 15.

The rotor is advantageously carried in bearings on the side on which the coolant/lubricant is taken in at the ring of the outer bearing in the lateral part 7 integral with the casing. Advantageously, when the rotor is carried by one side in a cantilever manner, a projection 6 integral with the casing extends into the corresponding positive displacement bore and carries both inner rings of the rotor's bearing. Additionally, when the rotor is carried in bearings by one side in a cantilever manner, the projection 6 integral with the casing preferably comprises the coolant admission 8. The rotor's bearing 5*a* which is nearer to the support advantageously absorbs the axial forces generated by the difference in working pressure when the rotor is carried in bearings by one side (cantilever) and is provided with a larger inner ring. When the rotor is carried in bearings by one side (cantilever), the rotor bearing 5*b* which is farther away from the support may be designed as a radial compact bearing (needle bearing, sliding bearing).

It is of advantage for all the afore mentioned examples of embodiment when the pressure of the discharge side is present on either front face of the positive displacement rotor.

Both sides of the displacer pair may be embodied with the same spindle feed screw thread. It is also possible to have one side of the displacer pair embodied as a simple leakage feed screw thread 25.

Centrifugal shaft seals are advantageously employed to seal the shaft entries. Additionally, a static, contacting (radial) packing ring 27 may be inserted into the rotating enclosure-like rotor element 4 behind the centrifugal siphon shaft seal. The packing seal 27 is hereby designed in such a way that, under the effect of centrifugal force, the sealing lip rises before the operational speed in attained. It is furthermore advantageous for sealing when long sealing paths with sealed gas option and leakage return screw thread are provided at the shaft seals of the compression chamber.

After having passed through the inner surfaces of the rotor, the coolant/lubricant is advantageously collected in at least one collecting pipe 18. The coolant/lubricant collected in the collecting pipe 18 may then be forwarded on purpose via bores 10. The coolant/lubricant collected in the collecting pipe 18 may particularly be carried away via at least one pressure tube 19 integral with the casing and engaging by one end into the collecting pipe 18. The collected coolant/lubricant may additionally be employed on purpose to cool down and lubricate the bearings and/or to cool down and lubricate the synchromesh and drive gear. This is also true when the coolant/lubricant is led toward a centrifugal shaft seal with stationary siphon 22 and toward a sealing disk 23 rotating together with the displacer spindle 1, 2 after having passed the inner surfaces of the rotor. Particular advantages are obtained when the sealing side wall of the siphon 22, which is integral with the casing is taken back in the area of engagement of the synchromesh gear in order to lubricate the gear.

It is particularly advantageous to always have the discharge of the pumping medium on the pump casing situated at the geodetic deepest possible position for horizontal and vertical rotor shaft position.

Synchronization of the two displacer spindles is preferably accomplished by way of a simple spur gear step 11.

It proved particularly advantageous to have the displacer spindle pair consisting of at least two feed screw sections which are graded relative to each other by the combination of at least two factors, at least one continuous variation in pitch at the same teeth height cooperating with at least one abrupt variation in the volumes of the pumping chamber at reduced teeth height. The inner graduating factor for the continuous variation in pitch may particularly amount to between 1.5 and 2.2, preferably to 1.85, and the abrupt graduating factor may amount to between 2.0 and 9.0, preferably between 4 and 6. Both feed screw sections may furthermore be graded with a continuous variation in pitch and an abrupt variation in the volume of the work chamber may occur between these two feed screw sections. It is particularly advantageous when the continuous variation in pitch in the first feed screw section on the side of suction is smaller than the continuous variation in pitch in the subsequent feed screw section. The continuous variation in pitch may particularly follow a nonlinear curve. It proved to be particularly advantageous when the outer diameter of the positive displacement rotor is reduced in the area of the abrupt transition between the feed screw sections as far as just underneath the height of the diameter of the pitch circle.

In an advantageous development of the screw pump according to the invention, a protection against excess pressure 28 is provided.

With regard to the course of the profile flank in the area of the pitch circle, it proved advantageous to have it mathematically designed as involute. The engagement line of the flank profile is preferably brought near to the edge of cut of the casing of the two surfaces of the inner cylinder. The course of the flank may hereby be composed of several simultaneously engaged profile contours.

Thanks to an obvious increase in pitch of the spindle, this dry-compressing screw pump may be employed as a Roots pump.

For gas cooling, the pre-intake may be used. By inverting the direction of flow of the pre-intake, the gas admissions of the pre-intake may be utilized as overload protection.

Particular advantages, particularly as far as noise is concerned, are obtained when the opening behaviour of the appropriate work/pumping chamber follows a function depending upon infinitesimal rotation and when any abrupt variation in section during the opening of the work/pumping chambers is avoided.

I claim:

1. A dry-compressing screw pump in the form of a two-shaft positive displacement pump, comprising:

a first and a second rotor spindle disposed parallel to each other and forming a rotor spindle pair that is disposed in a closed compression chamber;

wherein the rotor spindles are hollow, and have inner diameters;

wherein a cooling medium is red at a first front face of the rotor spindles and evacuated at a second front face of the rotor spindles;

wherein a cooling medium feeding and evacuation means is connected to an external cooling medium circuit;

wherein the inner diameters of the hollow rotor spindles continuously increase from the first front face toward the second front face, whereby the cooling medium is conveyed from the first front face to the second front face substantially under the influence of centrifugal force acting on the cooling medium due to the rotation of the rotor spindle.

2. The dry-compressing screw pump according to claim 1, wherein the rotor spindles are carried in bearings at the first front face on a stationary axle said axle being provided with a preferably coaxial bore through which the cooling medium is brought to the inner surfaces of the rotor.

3. The dry-compressing screw pump according to claim 2, wherein the rotor spindles are carried in bearings on a common axle at the first and second front face.

4. The dry compressing screw pump according to claim 1, wherein the temperature of the rotor spindles is controlled by the quantity of cooling medium passing there through.

5. The dry-compressing screw pump according to claim 1, wherein the rotor spindles are rotatably carried in bearings and the cooling medium passing through the inner space of the rotor spindles is at least partially utilized to lubricate and/or cool the bearings.

6. The dry-compressing screw pump according to claim 1, wherein the rotor spindles are made impervious to gas from the compression chamber by means of fluid-proof seals, the sealing fluid used therefor being at least part of the cooling medium passing through the inner space of the rotor spindles.

7. The dry-compressing screw pump according to claim 1, wherein the rotor spindles are synchronized by means of a gear; and wherein at least part of the cooling medium passing through the inner space of the rotor spindles lubricates and/or cools the gear.

8. The dry-compressing screw pump according to claim 2, wherein the stationary axle is embodied as a projection unremovably fixed to the casing.

9. The dry-compressing screw pump according to claim 1, wherein the inner surfaces of the rotor spindles are provided with an inner feed screw thread whose sense of rotation has been chosen so that a flow of cooling medium is generated under the influence of rotation of the corresponding rotor spindle that flows from the first front face toward the second front face.

10. The dry-compressing screw pump according to claim 2, wherein the adaption is performed by adequately selecting of the local thread pitches of the inner feed screw thread.

11. The dry-compressing screw pump according to claim 1, wherein the rotor spindles are carried in bearings at the second front face on a stationary axle said axle being provided with a preferably coaxial bore through which the cooling medium is carried off the cavities of the rotor spindles.

12. The dry-compressing screw pump according to claim 11, wherein the stationary axle is embodied as a projection unremovably fixed to the casing.

13. The dry-compressing screw pump according to claim 1, wherein the local flow of coolant on the inner surfaces of the rotor are adapted to the local heat load of the rotating rotor spindles.

14. The dry-compressing screw pump according to claim 2, wherein adaption is performed by adequately selecting the change of diameter of the inner surface.

15. The dry-compressing screw pump according to claim 1, wherein the local heat transfer ratio from the inner surfaces of the rotor spindles to the coolant is adapted to the local heat load of the rotating rotor spindles.

16. The dry-compressing screw pump according to claim 15, wherein the local heat transfer ratio from the inner surfaces of the rotor spindles to the coolant is adapted to the local heat load of the rotating rotor spindles by appropriately shaping the upper face of the inner surfaces.

17. The dry-compressing screw pump according to claim 15, wherein the local heat transfer ratio from the inner surfaces of the rotor spindles to the coolant is adapted to the local heat load of the rotating rotor spindles by approximately shaping the upper face of the inner surfaces by means of a purposeful variation of the surface roughness.

18. The dry-compressing screw pump according to claim 1, wherein, on the operating pump, the cooling medium forms a film having a thickness of less than 5 mm on the inner surfaces of the rotor.

19. The dry-compressing screw pump according to claim 18, wherein on the operating pump, the cooling medium forms a film having a thickness of less than 3 mm on the inner surfaces of the rotor.

20. The dry-compressing screw pump according to claim 18, wherein on the operating pump, the cooling medium forms a film having a thickness of less than 1 mm on the inner surface of the rotor.

21. The dry-compressing screw pump according to claim 1, wherein, on the operating pump, the speed of the rotor spindles is of more than 5000 revs/min.

22. The dry-compressing screw pump according to claim 21, wherein on the operating pump, the speed of the rotor spindles is of more than 7500 revs/min.

23. The dry-compressing screw pump according to claim 21, wherein on the operating pump, the speed of the rotor spindles is of more than 10,000 revs/min.

* * * * *